United States Patent [19]

Yasuda

[11] Patent Number: 4,629,584

[45] Date of Patent: Dec. 16, 1986

[54] COMPOSITION OF HEAT-SENSITIVE ELECTROSENSITIVE SUBSTANCES AND A PANEL HEATER MADE THEREFROM

[76] Inventor: Shigeyuki Yasuda, 1-5-11, Imaike, Chigusa-ku, Nagoya, Japan

[21] Appl. No.: 649,535

[22] Filed: Sep. 11, 1984

[51] Int. Cl.[4] ..... H01B 1/06

[52] U.S. Cl. ..... 252/511; 252/510; 219/548

[58] Field of Search ..... 252/510, 511, 543; 219/548; 428/209

[56] References Cited

U.S. PATENT DOCUMENTS 4,209,425 6/1980 Lin et al. ..... 252/510

OTHER PUBLICATIONS

Japanese Journal of Applied Physics, 10, No. 1, pp. 99–107 (1971), "A New Resistor Having an Anomalously Large Positive Temperature Coefficient".

*Primary Examiner*—Josephine L. Barr

*Attorney, Agent, or Firm*—Koda and Androlia

[57] ABSTRACT

A heat-sensitive electroresistive composite and a thermostatic heating unit made from the composite. The heat-sensitive electroresistive composites have the property of showing an abrupt variation in electric resistance depending on temperature, and they include organic compounds containing a plural number of alkylene oxides as the unit structure in their molecules and fine pieces of carbon in the form of powder, fiber, whiskers, etc. The above-mentioned organic compounds may be normal chain polyalkylene oxide and its derivatives or cyclic ether compounds. The mixing ratio of organic compounds to the fine pieces of carbon is, for example, 100 to 10-80, but the mixing ratio is not necessarily limited to the range for the other types of organic compounds and fine pieces of carbons. The thermostatic heating units are formed by sealing the heat-sensitive electroresistive composites together with electrodes within insulators. These thermostatic heating units may be a sheet form panel heater using a plastic sheet as the insulator.

2 Claims, 15 Drawing Figures

COMPOSITION OF HEAT-SENSITIVE ELECTROSENSITIVE SUBSTANCES AND A PANEL HEATER MADE THEREFROM

BACKGROUND OF THE INVENTION

1. Field of the Invention

This invention relates to a composition of heat-sensitive electroresistive substances and a panel heater made therefrom, and more particularly to a composition of heat-sensitive electroresistive substances whose electric resistance varies abruptly with a positive characteristic at a certain temperature level, and also to a thermostatic panel heater using the foregoing composition.

2. Description of the Prior Art

Barium titanate ceramics doped with a rare earth element, Y, Bi, or Sb are known as heat-sensitive resistors. Although barium titanate in its pure state is an insulator, it turn to be a semiconductor as a result of doping.

Generally, resistivities of semiconductors show negative temperature characteristics, namely, the resistivity decreases with increasing the temperature of the semiconductor. In the case of doped barium titanate ceramics the resistivity show negative temperature coefficients in the lower temperature region, but positive temperature coefficients appear at a temperature which is slightly lower than the Curie temperature. Over the temperature range between the temperature described above and the temperature which is higher than the Curie temperature by ~150° C., the positive temperature characteristics are observed. Because of this positive temperature coefficient characteristics, doped barium titanate ceramics give a steady-state constant temperature when electric power is supplied. Therefore, doped barium titanate ceramics are called as PTCR (positive temperature coefficient resistor). Electrical resistivity for the heat sensitive substances of this invention exhibits positive temperature characteristics which is much stronger than that of doped barium titanate. Although the mechanism of the electrical conductivity in the heat sensitive substances of this invention could probably be different from that in doped barium titanate, the term "positive temperature charactertistic" of "PTC (positive temperature coefficient) effect" used hereafter in the same sense at that for doped barium titanate because both give the same electrical characteristics, namely, constant temperature under the supply of electricity.

Besides doped barium titanate ceramics as inorganic substances the system of carbon-paraffin-polyethylene has been known as an organic substance which has a strong positive temperature characteristics.

On the other hand, as an organic material having sufficiently strong positive characteristics, the ternary system of carbon-paraffin-polyethylene has been known. However, this composition is poor in compatibility with carbon, and has a problem in the mixing method as well as in change in characteristics with the passage of time.

When a heat-sensitive electroresistive composite having a positive characteristic is raised in temperature from low range, the value of resistance increases precipitously when the temperature reaches a certain point. Also, in the contrary, when the temperature of the composite is lowered from the higher temperature range above the aforesaid certain point, the value of resistance decreases sharply at the certain point mentioned above. Now, when the composite provided by this invention is heated by supplying electricity, while the amperage of the electric current is high during the initial period, after a while, upon reaching a certain temperature the current becomes weak because the value of resistance increases suddenly. Thereafter, when the temperature of the composite is lowered by cooling it the resistance value decreases. As the result, the electric current becomes high in amperage again, and the temperature returns to the certain level. By utilizing the property described above, this composite can be used as a temperature sensor, temperature fuse, and thermostatic heating element.

Organic compounds with melting point around room temperature ±50° C., with the desirable properties, such as high thermal stability, low toxicity, and also are a good insulator of electricity, are found in large number. Such organic compounds are, for example, paraffins, polyalkylene glycols, higher alkyl ethers, higher alkyl esters, higher fatty acids, and higher alcohols.

Also, these organic compouhds are melted when heated from outside up to the degree above the melting point, and the heat is stored as latent heat of fusion, in those compounds. Accordingly, they are known as a regenerative media. By using systems without requiring additional installation of a temperature sensor and a thermal fuse separately inside of the heating unit.

In other words, the heat-sensitive electroresistive composite provided by this invention has the property that its temperature does not go up beyond a certain level as an inherent property of a resistor.

Consequently, the heating element using the foregoing composite is completely free of malfunction, and it is also extremely dependable and safe. Furthermore, in view of the energy consumption, since its temperature does not exceed a specified point, it suffers no energy loss. Thus, in addition to the above, it has an outstanding merit in terms of economy.

The present invention is intended, therefore, to provide a heat-sensitive electroresistive composite having desirable thermostatic properties including a positive characteristic. Furthermore, the inventor of this invention has designed a way to make heating elements, particularly sheet form (panel) heating type units, by sealing the composites together with electrodes in insulators. In this manner, the inventor has developed heating units which are quite suitable as the base materials for floor heating systems of buildings, heating carpets, heating mats for agricultural and stock farming applications, such as brooder, breeder, seedling culture, as well as for other uses.

This invention was achieved based on the following findings. That is, the inventor found that, among organic compounds, polyethylene glycol is remarkably high in compatibility regenerative media, the heat generated by the electric heater receiving the electricity from a generator using an irregular natural energy source, such as wind power (areogenerator), tidal power (tidal power plant), and solar energy (solar power plate), can be stored. However, the regenerative medium itself is a good insulator of electricity and it is impossible to energize it with electricity directly for heating. Therefore, it is necessary to heat it by using an electric heater, and also a thermostat or a thermoprotector must be provied for temperature control. This inevitably increases the cost for equipment.

SUMMARY OF THE INVENTION

To solve the problems of the prior art, a heat-sensitive electroresistive composite having a positive characteristics was used as a thermostatic heating element as mentioned above. The heat-sensitive electroresistive composite also functions as a temperature sensor and as a thermal fuse. Hence, it can be used for obtaining safe and economical accumulator and room-heating systems without requiring additional installation of a temperature sensor and a thermal fuse separately inside of the heating unit.

In other words, the heat-sensitive electroresistive composite provided by this invention has the property that its temperature does not go up beyond a certain level as an inherent property of a resistor.

Consequently, the heating element using the foregoing composite is completely free of malfunction, and it is also extremely dependable and safe. Furthermore, in view of the energy consumption, since its temperature does not exceed a specified point, it suffers no energy loss. Thus, in addition to the above, it has an outstanding merit in terms of economy.

The present invention is intended, therefore, to provide a heat-sensitive electroresistive composite having desirable thermostatic properties including a positive characteristic. Furthermore, the inventor of this invention has designed a way to make heating elements, particularly sheet form (panel) heating type units, by sealing the composites together with electrodes in insulators. In this manner, the inventor has developed heating units which are quite suitable as the base materials for floor heating systems of buildings, heating carpets, heating mats for agricultural and stock farming applications, such as brooder, breeder, seedling culture, as well as for other uses.

This invention was achieved based on the following findings. That is, the inventor found that, among organic compounds, polyethylene glycol is remarkably high in compatibility with carbon powder, he further conducted a strenuous study in order to find out the reason for the above. As a result, the inventor obtained confirmation that the organic compounds containing a plural number of alkyl oxides as the unit structures in their molecules show a far better miscibility with carbon powder than the other organic compounds, and that due to the above, they show positive characteristics in stable manner.

BRIEF DESCRIPTION OF THE DRAWINGS

The abovementioned features and objects will become more apparent from the following description wherein like reference numerals denote like elements and in which:

FIG. 2(*b*) is a sectional view taken along the line A—A in FIG. 2(*a*);

FIG. 3(*b*) is an enlarged sectional view taken along the line B—B in FIG. 3(*a*);

DETAILED DESCRIPTION OF THE INVENTION

Figure 1:
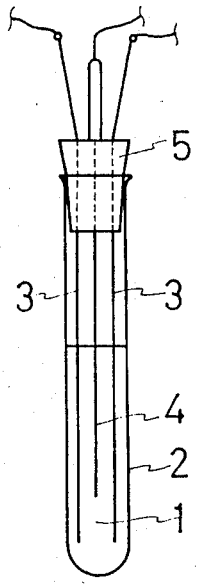
FIG. 1 is a side view of an electrical resistance measuring device.

The composites provided by this invention have strongly positive characteristics, and they are characterized as follows. That is, carbon contained in them are quite readily dispersed in the organic compounds which are specified by this invention. The organic compound has a plural number alkylene oxide as the unit structure in their molecules, and thus a remarkably conspicuous positive characteristics can be shown in stable manner by these components. The organic compounds which contain the plural number of alkylene oxides as the unit structure in their molecules show excellent positive characteristics, regardless of whether they are straight chain compounds or cyclic compounds. The actual examples of such organic compounds are listed below.

As the straight chain compounds, there are polyoxyalkylenes; for example, polyethylene glycol and its high molecular (weight) polyethylene oxide, block copolymers of polyoxyethylene and polyoxypropylene (so called Pluronic and Tetronic), polyoxyethylene alkyl ether, polyoxyethylene alkylallyl ether, polyoxyethylene alkyl ester, polyoxyethylene alkylamine, polyoxyethylene sorbitan fatty (acid) ester.

As the cyclic compounds, in addition to trioxane, there are many and various types of crown ethers, such as dibenzo-14-crown-4, 15-crown-5, benzo-15-crown-5, 18-crown-6, dibenzo-18-crown-6, dicyclohexyl-18-crown-6, dibenzo-21-crown-7, dibenzo-24-crown-8, dicyclohexyl-24-crown-8, tetrabenzo-24-crown-8, dibenzo-60-crown-20.

A concrete description on the positive characteristics of the heat-sensitive electroresistive composite using those compounds will be given later.

Carbons to be mixed with the organic compounds listed above as examples, which contain the plural number of alkylene oxide as the unit structure in their molecules, are fine fragments of carbon, such as graphite, active carbon, amorphous carbon, etc., in the form of powder, fiber, whiskers, composed of single crystals, etc. These carbons must be misicble with the foregoing normal chain or cyclic polyethers.

The most characteristic points of the mixtures of the aforesaid two components are that they are mixed homogeneously with high stability no matter what their composition ratio is, and that phase separation is not caused to them. Also, there is a range where the positive characteristics are shown at a certain mixing ratio of the micro-fragments of carbons. This mixing ratio is usually 10–80 compared with 100 in organic compounds. When the mixing ratio of the fine pieces of carbon is below 10, the electricity is not transmitted due to the high resistance. On the contrary, when the composition ratio of the fine pieces of carbon becomes above 80, the electric conductivity gets too high and positive characteristics do not appear within the temperature range investigated (−20∼130° C.). However, the abovementioned range of mixing ratio where the positive characteristics are shown differs largely depending on the type of organic compounds as well as the type of fine pieces of carbon. Therefore, such a range is not limited to that mentioned above.

For the organic compounds, alkylene oxide group present in plural number in their molecules plays an important role in the dispersion of the fine pieces of carbon. Accordingly, this alkylene oxide is assumed to be a factor for bringing about the markedly stable and strongly positive characteristics shown by the composites obtained from the foregoing organic compounds and micro-fragments of carbons.

The following was proved by actual examples of the embodiments of this invention which will be mentioned later. That is, the positive characteristics are shown when plural number of alkylene oxide groups, regardless of their form, whether normal chain or cyclic, are present in molecules. The above is established even for trioxane containing only 3 sets of alkylene oxide groups, or even when chemical bond between alkylene oxides themselves is severed by the benzene nucleus in crown esters or by the six-membered ring of cyclohexane.

Polyethylene glycol shows the most desirable properties in the process of development up to now. Also, it has been confirmed that it shows the positive characteristics even when ethylene groups in polyethylene glycol molecules are partially replaced by propylene groups, or when its terminal group is changed from hydroxyl group, by substituting an alkoxy group, such as methoxy group, or by alkyl ester or alkylamine.

As has been mentioned above, the reason that the mixtures of organic compounds containing a plural number of alkylene oxide as the unit structure in their molecules and the fine flinters of carbons show the conspicuously positive characteristic is not fully clarified yet, but the following is conceivable. That is, the fact that these compounds have a property highly strongly facilitating the homogeneous dispersion of carbon powder, etc. contributes to the abovementioned tendency of showing a high degree of positive characteristics.

The reasons for the assumption mentioned above are given below. First, it is a well known fact that protrons and metallic ions are coordinated with lone pairs of electrons on oxygen atoms in alkylene oxide groups. On the other hand, the following are also widely known facts. That is, the fine piece of carbon have the graphite structure, and the $\pi$ electrons can move within the conjugated system, thus providing electric conductivity. It is assumed that the $\pi$ electrons of graphite are localized in some local part of graphite crystal which causes the other portion in the crystal to be positively charged. If it is assumed that this positive portion is coordinated with the lone pair of electrons on oxygen atoms in alkylene oxide, the excellent dispersibility of fine pieces of carbon can be explained.

As to the conduction mechanism of the mixture system of the organic compound and fine fragments of carbon, in the region where the carbon particles are in the state of complete mutual contact the Ohmic conduction mechanism provides the explanation. On the other hand, as to the region where there exist extremely small spaces between the particles, the tunnel effect can be applied to explain the conduction mechanism.

Figure 4:
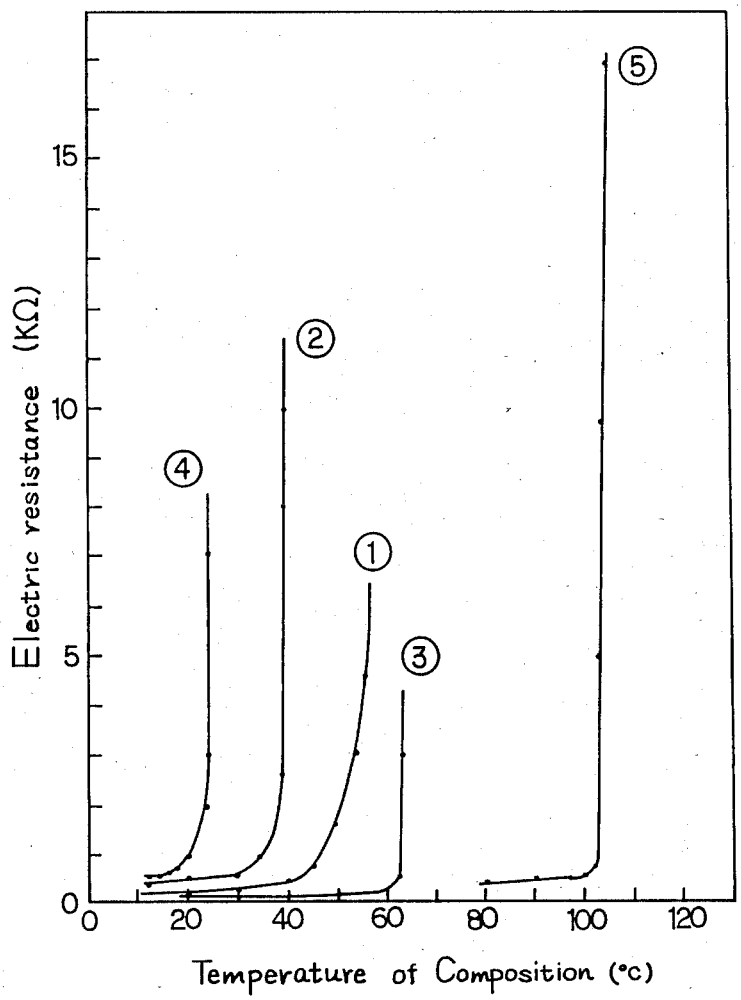
FIG. 4 is a graph showing the relation between the temperature and the electric resistance of cyclic polyethers in Embodiments 1–5.
Figure 7:
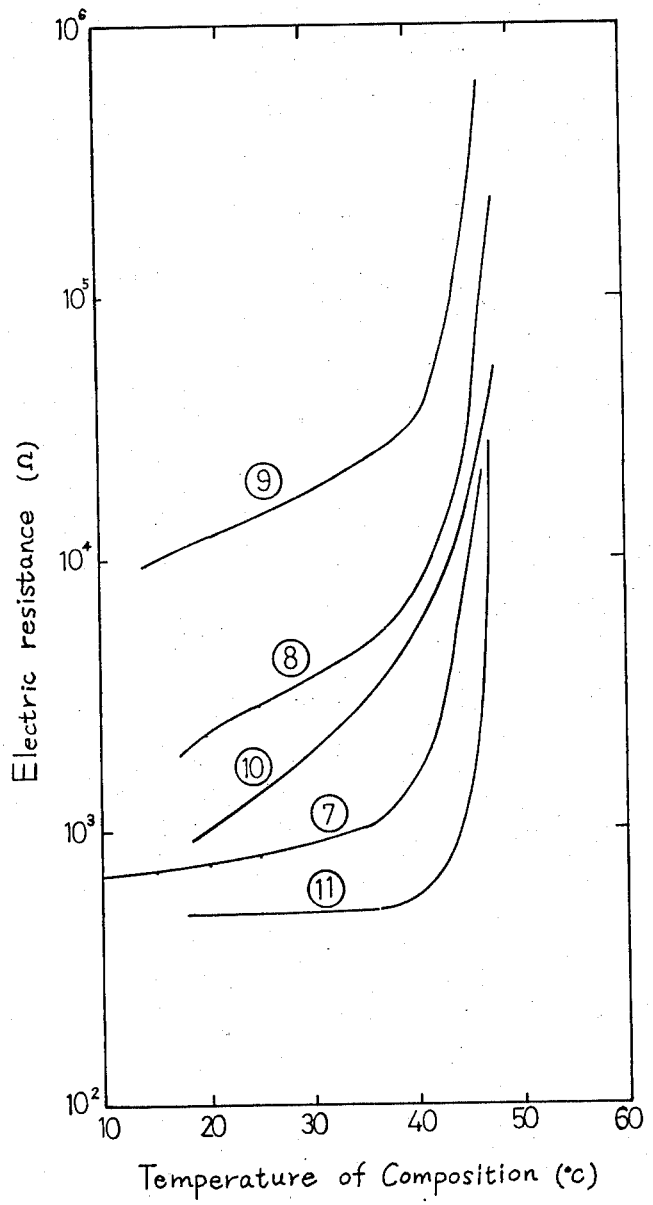
FIG. 7 is a graph showing the relation between the temperature and the electric resistance of straight chain polyethers in Embodiments 7–11.

As will be explained with reference to the embodiments shown later, in the positive characteristics, the sharp increase in electric resistance value is observed during the feeding of electricity at the temperature below the melting point of the organic compound medium. The data for the above is shown in Table 1. Also, the relations between the temperature and the value of electric resistance of respective composites are shown in FIG. 4 and FIG. 7.

TABLE 1

| Organic Compound | Melting Point (°C.) | Amount of fine pieces of carbon mixed (wt %) | Temperature where the resistance value shows the sharp rise (°C.) |
|---|---|---|---|
| Trioxane | 64 | 25 | 40 |
| 18-crown-6 | 39–40 | 28 | 38 |
| Benzo-15-crown-5 | 79–79.5 | 28 | 62 |
| Dicyclohexyl-18-crown-6 | 38–54 | 28 | 24 |
| Dibenzo-24-crown-8 | 113–114 | 28 | 102 |
| Polyethylene glycol #6000 | 56–61 | | |
| Polyethylene glycol #2000 | 49–53 | 28 | 42–46 |
| Pluronic F68, F88 | 50 | 28 | 46 |
| Pluronic F88 | 50 | 28 | 46 |

The heat sensitive electroresistive composites as listed above are formed into heat-sensitive electroresistive composite sheets by using them as they are or by using them after letting the non-conductive sheets, such as a thin woven fabric, non-woven fabric and sponge sheet, be impregnated with them so that the non-conductive sheets carry the foregoing composites in them. Them, each of the heat-sensitive electroresistive composite sheets thus obtained is sealed in two non-conductive cover sheets applied to front and back sides of the former. At the same time, inside of the assembly prepared as mentioned above, conductors (lead wires) are buried at specified intervals. As a whole, all of those components are made into a thin sheet form. In this way, a sheet form (panel) heating unit with the desirable property is obtained. Needless to say, even without being formed into thin sheet, the assembly of the components is sufficiently effective as a heating unit. However, when they are processed to take the sheet form, material required can be cut down in quantity, and also a heating panel ideal for floor heating, wall heating, etc. can be obtained. Besides, as the heating unit itself has the positive characteristics, it functions also as thermostat as well as thermoprotector, thereby making it feasible to simplify the structure, to completely free itself from possible failure in performance, and in addition, to lower the production cost substantially.

Figure 13:
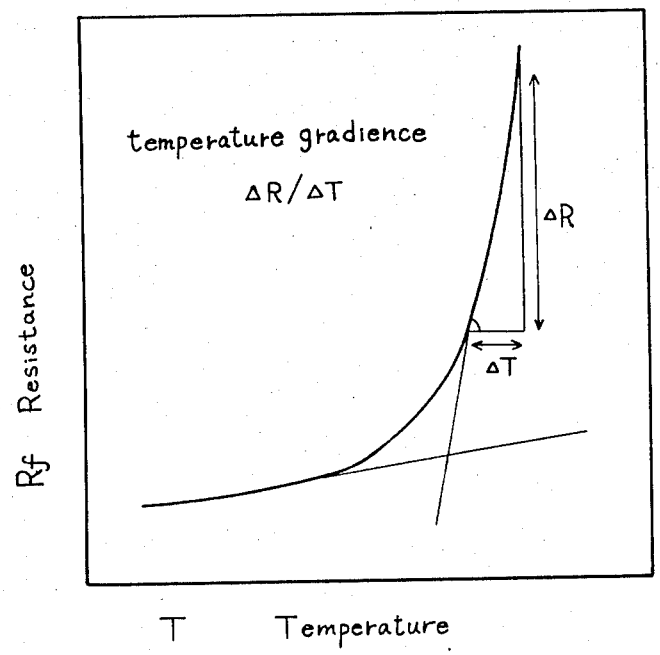
FIG. 13 is a graph showing the Resistance-temperature curve of the heat-sensitive element.

In the end of this section, the heat sensitive substances of this invention are compared with doped barium titanates ceramics. It is obvious that barium titanates ceramics have characteristics as general ceramics, namely, mechanically strong and stable at high temperature. The heat sensitive substances of this invention have various useful characteristics which are not seen for doped barium titanate ceramics. Those are described below:

1. PTC characteristics of this invention is much stronger than that of doped barium titanate ceramics. In order to evaluate PTC characteristics, the values of the temperature gradience in Resistance-Temperature Cruve deviated by Rf (see FIG. 13) is taken for the heat sensitive substance of this invention and doped barium titanate ceramics and compared with each other. The value for the heat sensitive substance of this invention is taken from the data of Embodiment 2 and that for the doped barium titanate from J. Am. Ceram. Soc., 47,484 (1964). The values are 59.6/° C. for this invention and 11.8 for the barium titanate ceramics. This means that in order to get the same increase in the relative resistance of the substance in Embodiment 2 when the temperature is increased by 1° C., it is necessary to increase the temperature of the barium titanate ceramics by ~5° C.

2. In the case of doped barium titanate ceramics it is possible to lower the Curie temperature by the increase in the dopant concentration. However, there is a higher limit for ceramics to be a semiconductor. Too high concentration of a dopant makes the ceramics to be insulators. Therefore, the lower limit of steady state constant temperature of doped barium titanate heater is ~70° C. On the other hand, heaters from the heat sensitive substances of this invention could give a steady state constant temperature as low as ~20° C. (see Embodiment 4). Actually the panel heater of Embodiment 13 gives the constant temperature 50° C. (see FIG. 9). Heaters of a lower constant temperature save energy consumption when they are properly used.

3. In the case of barium titanate ceramics, it is difficult to produce heaters with wide surfaces. However, it is quite easy to produce a sheet form panel heater with surfaces as wide as necessary.

4. It is also possible to produce thin flexible sheet form heaters from the heat sensitive substances (see Embodiment 6).

As is described above, the strong PCT characteristics, a proper constant temperature (probably 30~50° C.), wide surface and the flexibility are essential for room heating panel.

Hereunder, a concrete description on the effects of the heat-sensitive electroresistive composites according to this invention as well as on the characteristics of the heating units using the former will be given with reference to the embodiments of this invention.

EMBODIMENT 1

Ten grams of heat-sensitive electroresistive composite 1 obtained by mixing 25 wt. % of graphite carbon (produced by Yoneyama Yakuhin Kogyo Co., Ltd. Japan) and 75 wt. % of trioxane (extra pure reagent from Nakarai Kagaku Yakuhin, Co., Ltd. Japan) was placed in a test tube 2 of 10 mm in outside diameter as shown in FIG. 1. Then, the composite was melted by heating and stirred quickly. Thereafter, the mouth of the test tube was sealed with a silicone rubber stopper 5 fitted with stainless steel electrodes 3 and temperature sensor 4 (covered with Teflon film). While raising the temperature gradually (about 2° C./min) from around 12° C. in an air thermostatic oven, the temperature and the value of resistance were measured by using a Takara Kogyo Digital Multi D611 and Takeda-Riken Digital Multimeter TR6841.

The results of the measurements are shown by the curve ① in FIG. 4. As is seen in FIG. 4, when the temperature of the heat-sensitive electroresistive composite 1 exceeded 40° C., the variation in resistance value began to be conspicuous, and when the temperature passed the line of 50° C., the resistance value increased sharply with the positive characteristics shown distinctly. The inflection point of the resistance value was about 47° C. which is lower than the melting point of 64° C. of trioxane.

EMBODIMENT 2

A mixture of 28 wt. % of graphite carbon used in Embodiment 1 and 72 wt. % of 18-crown-6 (from Merk Co. of West Germany) was melted and stirred in the same manner as used in Embodiment 1. Then, as shown in FIG. 1, the temperature sensor 4, the stainless steel electrodes 3, and the silicone rubber stopper 5 were fitted. Thereafter, the temperature-resistance curve was plotted. The result is shown by the curve ② in FIG. 4. At 39° C., the resistance value showed a rapid increase and the clear-cut positive characteristics were observed.

EMBODIMENT 3

In the same manner as employed in Embodiment 1, a mixture of 28 wt. % of graphite carbon and 72 wt. % of benzo- 15-crown-5 (from Nakarai Kagaku Co., Ltd.) was melted and stirred. Thereafter, as shown in FIG. 1, the temperature sensor 4, the stainless steel electrodes 3, and the silicone rubber stopper 5 were installed, and the resistance value at each temperature was measured. The result is represented by the curve ③ of FIG. 4. In this case, when the temperature rose beyond 60° C., the resistance value increased rapidly, with the accompanying positive characteristics appearing clearly.

EMBODIMENT 4

Figure 2:
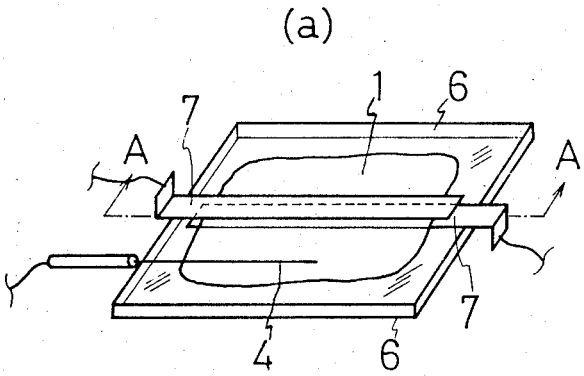
FIG. 2(*a*) is a perspective view.
Figure 2:
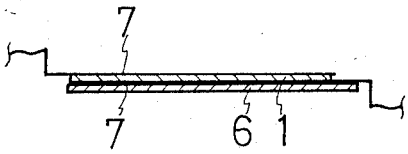

Twenty-eight wt. % of graphite carbon and 72 wt. % of dicyclohexyl-18-crown-6 (produced by Nakarai Kagaku Co., Ltd.) were melted and mixed. Then, as shown in FIGS. 2(*a*) and 2(*b*), the mixture was spread over a copper foil 7 on a glass board 6. Furthermore, on top of it, another copper foil 7 was bonded. The temperature sensor 4 was also provided, and the resistance value at each temperature was measured. The results of the measurement are shown by the graph 4 in FIG. 4. When the temperature exceeded 24° C., the abrupt increase in resistance value was observed, and the highly positive characteristic was exhibited.

EMBODIMENT 5

Graphite carbon in an amount of 28 wt. % and 72 wt. % of dibenzo-24-crown-8 (from Nakarai Kagaku Yakuhin Co., Ltd. Japan) where heated and melted in the test tube the same as in Embodiment 1, and the resistance value at respective temperatures were measured. The results are indicated by the curve ⑤ in FIG. 5. When the temperature reached a level over 102°-103° C., the resistance value started to increase with a quick pace, and the strongly positive characteristics was obtained in the high temperature range.

EMBODIMENT 6

Composites obtained by mixing polyethylene glycol (herein after will be called PEG #6000 from Dai-ichi Kogyo Seiyaku Co., Ltd. Japan) with 20, 40, 60, and 80 wt. % of graphite carbon, respectively, were placed in glass petri dishes (each petri dish is 12 cm in diameter and 2.5 cm in depth), respectively. Then, two copper plates with 0.4 mm thickness and 25 mm×60 mm area were immersed and disposed as electrodes, with a distance of 9 cm provided between them. The foregoing mixture was cooled to room temperature and solidified, then, it as connected to a 100 V a.c. power source to start feeding the electricity. The duration of power supply, the variation in temperature, the variation in electric current, and the resistance value during the initial period and the terminal period of power supply were measured. The relation between the time (duration) and the temperature during 5 minutes in the initial period of power supply is shown in FIG. 5, and the relation between the temperature and the amperage of current for the same period is shown in FIG. 6.

Figure 5:
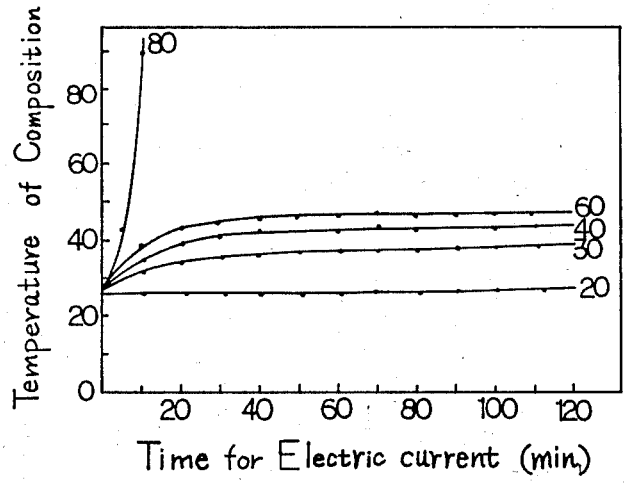
FIG. 5 is a graph showing the relation between the duration of electric current feeding the temperature for various compositional ratios of graphite to polyethylene glycol in Embodiment 6.
Figure 6:
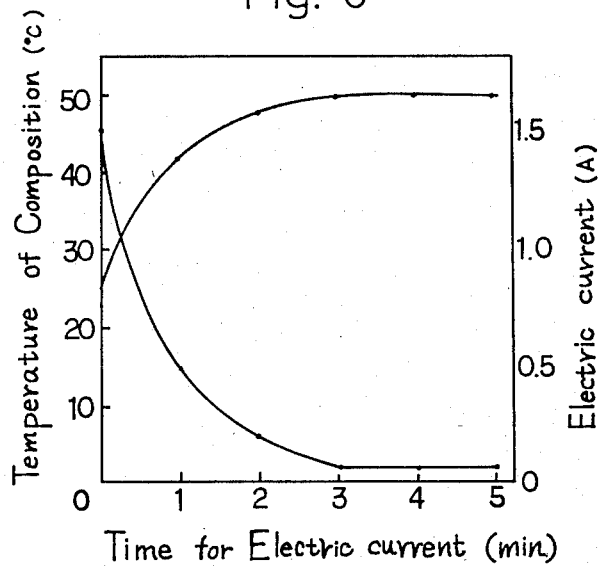
FIG. 6 is a graph showing the relationship between the electrocurrent feeding time, the temperature and the electrocurrent, for the same composite.

As shown in FIG. 5, with 20 wt. % of carbon, the rise in temperature after the power feeding was not observed. With 80 wt. % of carbon, the temperature showed a sharp climb after the supply of power. At 30–60 wt. % in concentration of carbon, the temperature rose after the supply of power, and thereafter, the temperature was maintained constant at a certain level. It is evident also from FIG. 6 that the foregoing phenomena is due to the positive characteristic of heat-sensitive electroresistive composite 1. During the rise of temperature, the resistance value increases abruptly when the temperature exceeds a certain point. As the result, the amperage becomes low. When the temperature becomes constant, the amperage also becomes very low as shown in FIG. 6. FIG. 6 shows the result for the case of 30 wt. % in carbon concentration out of those shown in FIG. 5.

EMBODIMENT 7

Figure 3:
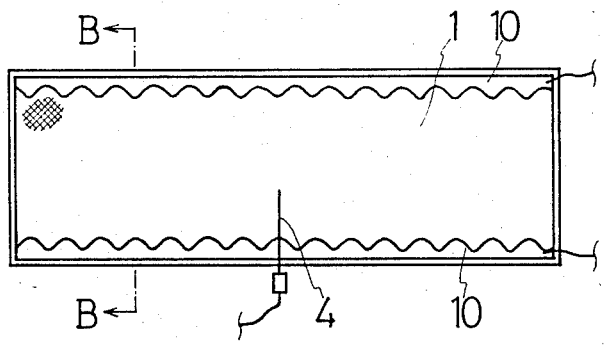
FIG. 3(*a*) is a plan view.
Figure 3:
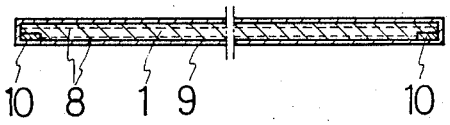

A mixture of PEG #6000, PEG #2000 (from the same company) and graphite carbon with a ratio by weight of 5:5:4 was melted by heating and stirred. Then, as shown in FIGS. 3(*a*) and 3(*b*), the mixture was poured into the space between two non-conductive sheets 9 (300×80×0.16 mm) made of polyester sheet lined with a fiber layer 8. On both sides, copper foil tape electrodes 10 were installed. The total thickness was 0.25 mm. Onto the surface thereof a temperature sensor 4 was mounted, and the resistance value at each temperature was measured. The result obtained is shown by the curve (7) in FIG. 7. At 40° C., the flection point of the gradient was observed, and the positive characteristic was shown distinctly.

EMBODIMENT 8

Graphite carbon in amount of 28 wt. % was mixed with Pluronic wherein straight chains of poly (oxyethylene) are bonded to both ends of the normal chain molecules of poly (oxypropylene) (F 68 from Asahi Denka Kogyo K.K. Japan, 8000 in average molecular weight). Then, after being melted by heating, the mixture was formed into a sheet as shown in FIG. 3 by the same process as taken in Embodiment 7. The resistance value at each temperature was measured, and the result indicated by the curve (8) in FIG. 7 was obtained. At a temperature beyond 46° C., the resistance value increased sharply, and a clear cut positive characteristic was shown.

EMBODIMENT 9

Into Pluronic F88 (11800 in average molecular weight), which is the same as that in Embodiment 8 but somewhat greater in average molecular weight, 28 wt. % of graphite carbon was mixed. Thereafter, the measurement was carried out in the same manner as in Embodiment 8. The results are represented by the curve (9) in FIG. 7. Same as in Embodiment 8, a highly positive characteristic was confirmed.

EMBODIMENT 10

Graphite carbon in amount of 28 wt. % was mixed into PEG #5000 wherein the terminal are etherified with methoxy group (Dai-ichi Kogyo Seiyaku Co., Ltd. Japan), and the same as shown in FIG. 3. Then, the resistance values at respective temperatures were measured. The curve (10) in FIG. 7 represents the results of measurement. At around 45° C., the resistance value started to increase rapidly, with the highly positive characteristic appearing at the same time.

EMBODIMENT 11

Into a mixture of PEG #6000 and PEG #2000 with a ratio by weight of 1:1, 40 wt. % of fine splinters of carbon fiber (M-201s from Kureha Chemical Industry Co., Ltd. Japan, 15μ in diameter, 130μ in length) was mixed. Then, as in Embodiment 7, the mixture thus prepared was formed into a sheet as shown in FIG. 3. The resistance value at each temperature was measured, and the result shown by the curve (11) in FIG. 7 was obtained. From about 44° C., a high rate rise in resistance value was shown, and the positive characteristic was demonstrated clearly.

EMBODIMENT 12

FIG. 3(*a*) is a plan view showing the basic embodiment of the panel (sheet form) heating element, and FIG. 3(*b*) is an enlarged sectional view taken along the line B—B thereof. In this embodiment, for sealing the heat-sensitive electroresistive composite 1 having the characteristics shown in FIG. 6 and described in the Embodiment 6 in the space between two rectangular non-conductive cover sheets 9 and 9 used as insulators, a fiber layer 8 made of cotton gauze was impregnated with the heat-sensitive electroresistive composite 1. Also, the copper foil tape electrodes 10 and 10 provided at the edge portions on both sides along the longitudinal direction of the sheet were used as conductors. The non-conductive cover sheets 9 and 9 are the laminted film formed of polyester film and an ethylene-vinyl acetate copolymer film, and their edges were fused together by heat. The sheet form heating unit is 300 mm in length and 100 mm in width. It is a very thin sheet with a thickness of less than 2 mm at maximum. The characteristics of such sheet with various types of heat-sensitive electroresistive composite 1 sealed in them, respectively, are described in the embodiments starting from 14.

EMBODIMENT 13

Figure 8:
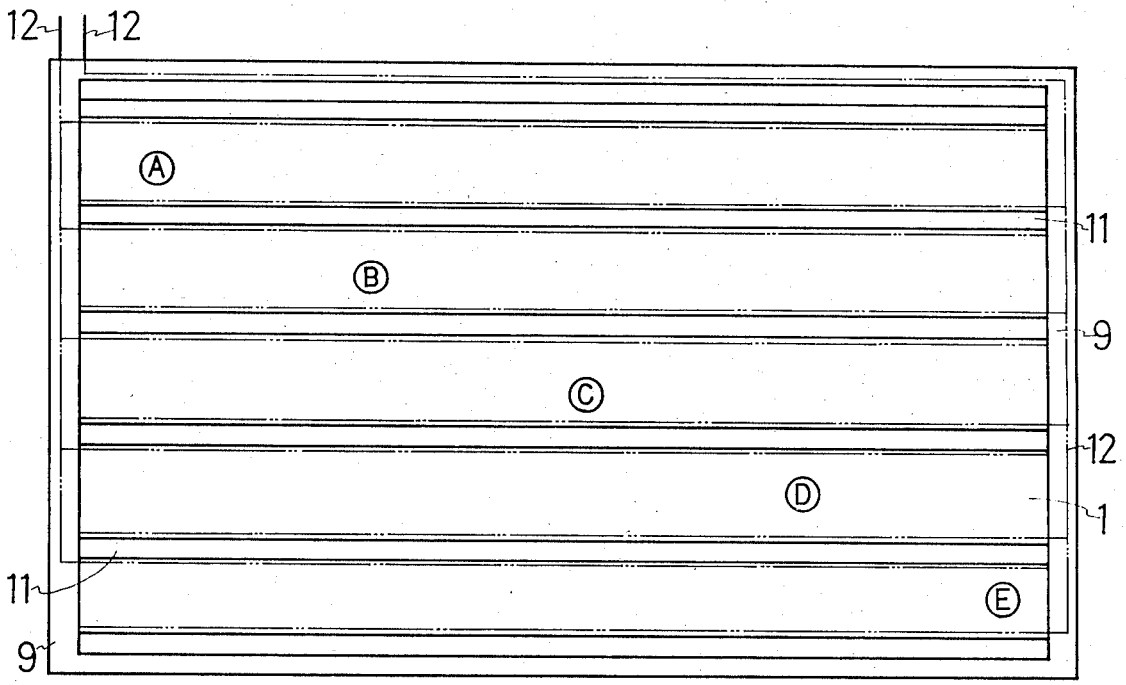
FIG. 8 is a plan view showing a sheet form heating element.

The embodiment shown in FIG. 8 is a large size sheet form heating unit. This sheet form heating unit of 500 mm in vertical length, 850 mm in width and about 4 mm in thickness was made by using 2 non-conductive sheets 9 and 9 made of polycarbonate plates of 1 mm in thickness. The inside of this sheet form heating unit is divided into fifths along the longitudinal direction into narrow sections by using butyl tape of 5 mm in width and 2 mm in thickness. In this way, fine compartments of thin space that is about 75 mm in width and about 830 mm in length were formed. Then, on both sides of the respective partition tapes 11 made of the butyl tape, conductors 12 and 12 with a capacity of ten amps were disposed. Each of the thin spaces was filled, without any special treatment with 120 g of the heat-sensitive electroresistive composite 1. The composition ratio of the heat-sensitive electroresistive composite 1 was 600 g of PEG (#6000) to 295 g of graphite powder.

Table 2 shows the relationship between the duration (time) of the connection of the abovementioned sheet form heating unit to a 100 V a.c. power source and the surface temperatures at A–E positions in FIG. 8.

As is seen clearly from Table 2, right after the start of current feeding, as much as 7 A of current flowed; but after one minute, it became 2 A; and after 5–10 minutes, it became nearly an equilibrium value of 0.6 A. Also, the temperature reached 34° C. from 21° C., and it became a heating element that functions as a thermostat without letting the temperature go up to a range beyond 37° C. Then, when the temperature went down, the amperage was increased because the resistance value decreased. Thus, the temperature returned again to a certain level. Therefore, it is most suitable as a thermal mat. For this embodiment, a sheet of thick cloth was placed over the surface of the sheet form heating unit, and the surface temperature was measured from tne outside of this covering cloth.

TABLE 2

| Time | Current (A) | Surface Temperature (°C.) A | B | C | D | E |
|---|---|---|---|---|---|---|
| Right After Start of Power Supply | 7 | 21 | 21 | 21 | 21 | 21 |
| 0.5 | 3.8 | 22 | 22 | 23.4 | 23 | 23 |
| 1 | 1.89 | 23 | 23 | 23.9 | 24 | 23 |
| 1.5 | 1.30 | 25 | 25 | 26 | 25 | 24 |
| 2 | 1.0 | 27 | 27 | 28 | 28 | 27 |
| 3 | 0.89 | 29 | 29 | 30.4 | 29 | 28 |
| 5 | 0.74 | 32 | 32 | 33.4 | 33 | 31 |
| 10 | 0.64 | 34 | 34 | 35.3 | 35 | 34 |
| 20 | 0.61 | 35 | 35 | 36.4 | 37 | 35 |
| 60 | 0.59 | 37 | 37 | 36.6 | 37 | 36 |
| 300 | 0.62 | 37 | 37 | 36.2 | 37 | 36 |

Hereunder, a further detailed description will be given with reference to the Embodiments having the structure shown in FIGS. 3(*a*) and 3(*b*) referred to in Embodiment 12, but using other heat-sensitive electroresistive composites.

EMBODIMENT 14

Figure 9:
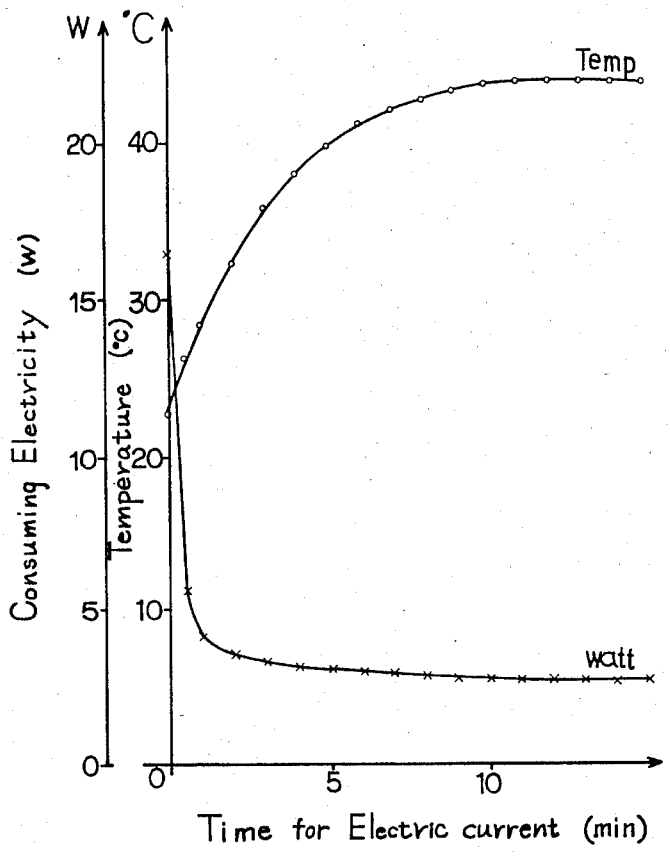
FIGS. 9, 10, 11 and 12 are graphs showing the relations between current feeding time and temperature as well as the current feeding time and current (or power consumption), for sheet form (panel) heating elements as embodiments of this invention.

A composite containing PEG #2000, PEG #6000 and graphite carbon with a ratio by weight of 5:5:4 was stirred after becoming molten by heating. Then, the composite was inserted between two polyester sheets lined with a fiber layer (thickness of the polyester sheet with fiber layer of 100μ) as seen in FIG. 3(*a*), and the entire assembly was formed into a sheet (300 mm in length, 80 mm in width) with a thickness of 250μ. The electrode used was the zigzag copper tape as shown in the figure which was adhered in advance to inside of a polyester sheet (each electrode on both sides). An electric current of 100 V a.c. was fed to this sheet form heating unit, and the temperature and power consumption at respective times after the start of the supply of power were measured. The results are shown in FIG. 9. After the current feeding, the temperature rose gradually approaching the saturation value. In the meantime, the power consumption reduced rapidly with the passage of time, and reached a certain constant level.

EMBODIMENT 15

Figure 10:
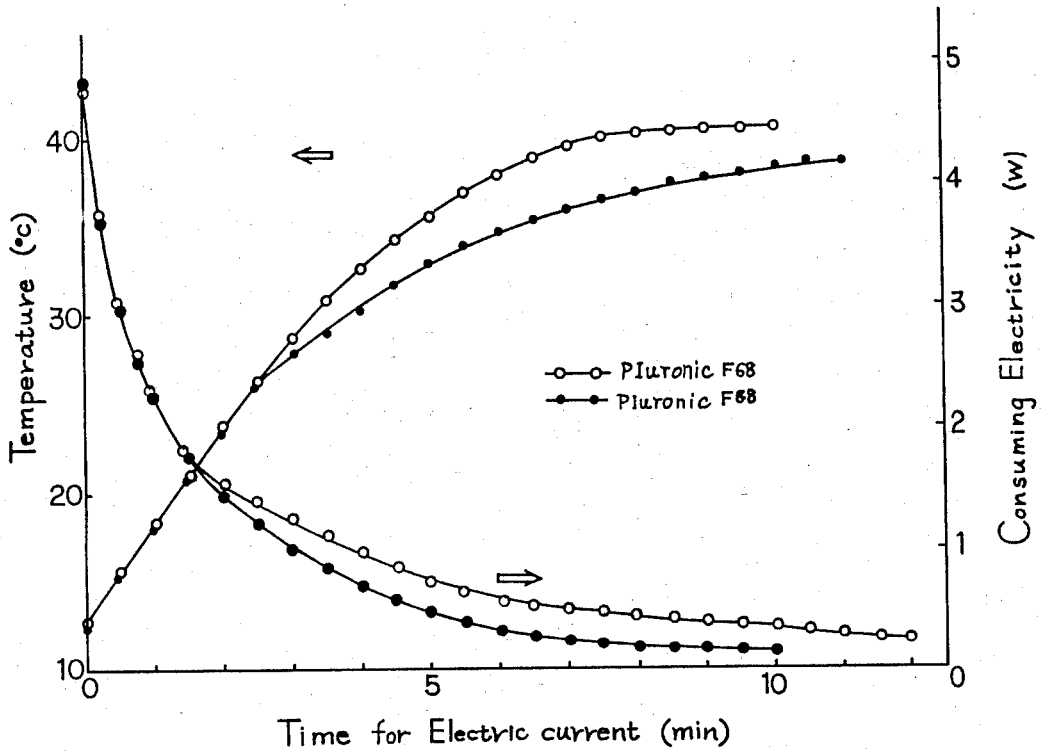

A composite containing poly(oxypropylene) glycol etheylene oxide (hereafter, will be called Pluronic) (8000 in average molecular weight, Pluronic F 68 from Asashi Kagaku Kogyo K.K.) and graphite carbon with the ratio weight of 10:4 and a composite containing Pluronic F 88 (11800 in average molecular weight) and graphite carbon with a ratio by weight of 10:4 were melted, respectively. Then, they were formed into sheet form heating elements the same type as in Embodiment 12. Thereafter, the power of 100 V a.c. and 200 V a.c. were fed to the heating elements containing F68 and F88, respectively and the temperature and the amperage were measured. The results are shown in FIG. 10. Also with Pluronic F68 and Pluronic 88 having the structure wherein PEG is bonded to both ends of the polypropylene glycol chain, the temperature rose after the supply of power, and then, after a while, became a certain constant level, while, corresponding to the above, the amperage decreased and reached a constant value after a short time. Therefore, also in the case, it is possible to obtain sheet form heating units.

EMBODIMENT 16

Figure 11:
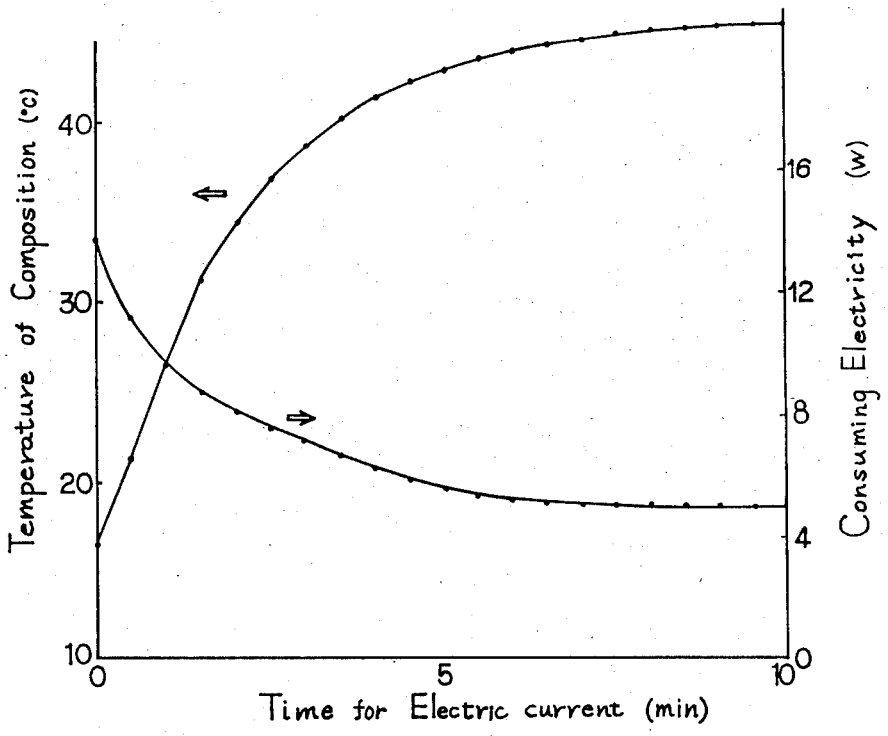

A mixture of 10 parts (parts by weight) of PEG #5000 wherein the ends are methoxidized and 4 parts of graphite carbon were melted by heating and stirring. Then, the same as in Embodiment 12, it was formed into a sheet form heating element, and the temperature and the resistance value at each time after the feeding of electricity 100 V a.c. were measured. The results are shown in FIG. 11. Also in this case, the temperature rose after the current feeding, and became a constant temperature after a while. In parallel with the above, the current decreased, then became constant in value after a short time.

EMBODIMENT 17

Figure 12:
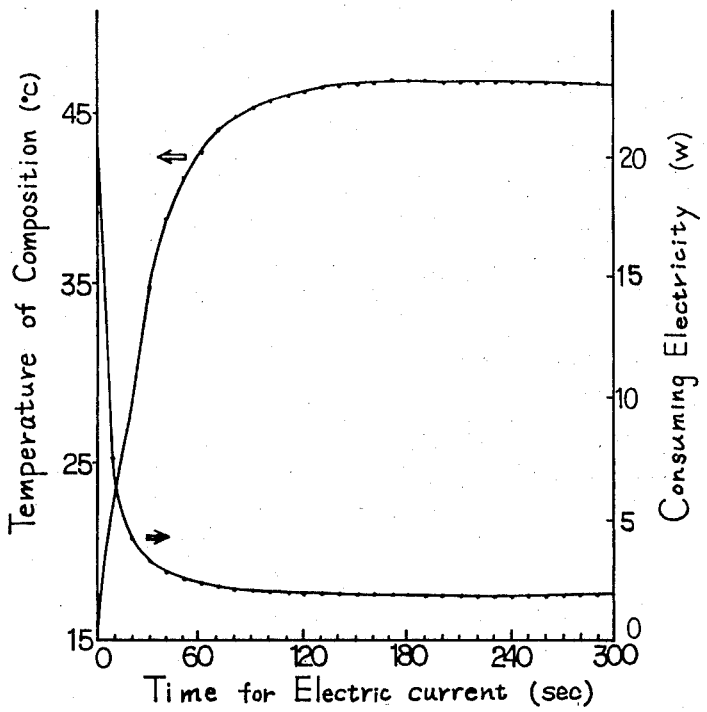

A composite of PEG #2000, PEG #6000 and the abovementioned fine pieces of carbon fiber (M-201 S from Kureha Chemical Industry Co., Ltd. Japan) with a ratio by weight of 3:3:4 was stirred after melted by heating, and formed into a sheet form heating unit as in Embodiment 12. Then, the temperature and the resistance value at each time after feeding the current of 100 V a.c. were measured. The results are shown in FIG. 12. Same as in the foregoing Embodiments 14 through 16, the temperature went up after the supply of power and then became a constant temperature. Meanwhile, the wattage also reached an equilibrium after being reduced to a certain point. Thus, it was proved that it can be applied as a safe and stable heating unit to various types of uses.

I claim:

1. A heat-sensitive electroresistive composite which exhibits an abrupt change in electric resistance with increasing temperature, which consists of:

organic compounds containing a plural number of alkylene oxides as the unit structure in their molecules selected from the group consisting of straight chain polyalkylene oxide and its derivatives or cyclic ether compounds; and fine splinters of carbon in the form of powder, fiber, or whisker.

2. A heat-sensitive electroresistive composite as set forth in claim 1, wherein the organic compound consists of polyethylene glycol and said fine splinters of carbon comprises graphite powder with mixing ratio fo 100 wt. % in polyethylene glycol to 10–80 wt. % of graphite powder.

* * * * *